US009261846B2

(12) United States Patent
Kato et al.

(10) Patent No.: US 9,261,846 B2
(45) Date of Patent: Feb. 16, 2016

(54) IMAGE FORMING APPARATUS INCLUDING POWER FEEDING MEMBERS CONFIGURED TO HOLD A CIRCUIT BOARD

(71) Applicant: CANON KABUSHIKI KAISHA, Tokyo (JP)

(72) Inventors: Hirohisa Kato, Tsukubamirai (JP); Kazumi Sato, Kashiwa (JP); Toshifumi Kakutani, Abiko (JP); Takeyuki Suda, Nagareyama (JP); Yousuke Hata, Ichikawa (JP); Shinya Suzuki, Toride (JP); Manabu Koseki, Sakuragawa (JP); Toshiyuki Abe, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/592,191

(22) Filed: Jan. 8, 2015

(65) Prior Publication Data

US 2015/0205246 A1 Jul. 23, 2015

(30) Foreign Application Priority Data

Jan. 17, 2014 (JP) ..... 2014-006829

(51) Int. Cl.
*G03G 15/00* (2006.01)

(52) U.S. Cl.
CPC ..... *G03G 15/80* (2013.01)

(58) Field of Classification Search
CPC ..... G03G 15/80
USPC ..... 399/88, 89, 90
See application file for complete search history.

(56) References Cited

U.S. PATENT DOCUMENTS

| | | | | |
|---|---|---|---|---|
| 6,173,150 | B1 | 1/2001 | Suzuki | |
| 6,438,337 | B1 | 8/2002 | Abe | |
| 6,821,132 | B2 * | 11/2004 | Tomimori | 439/76.1 |
| 6,951,688 | B2 | 10/2005 | Kato | |
| 7,266,321 | B2 * | 9/2007 | Ahn et al. | 399/90 |
| 7,369,788 | B2 * | 5/2008 | Omura et al. | 399/88 |
| 8,401,418 | B2 * | 3/2013 | Souda | 399/90 |
| 8,750,745 | B2 | 6/2014 | Fujiwara | |
| 8,880,763 | B2 | 11/2014 | Hata | |
| 2014/0369704 | A1 | 12/2014 | Matsumoto | |
| 2015/0016835 | A1 | 1/2015 | Kakutani | |

* cited by examiner

*Primary Examiner* — William J Royer
(74) *Attorney, Agent, or Firm* — Fitzpatrick, Cella, Harper & Scinto

(57) ABSTRACT

An image forming apparatus including: a plurality of process units; a circuit board configured to generate voltages to be applied to the plurality of process units; and a plurality of separate power feeding members configured to supply the voltages to the process units, wherein the plurality of separate power feeding members holds the circuit board, the circuit board including: a plurality of voltage output portions arranged at different positions in a direction along an outer edge of the circuit board; and a plurality of positioning holes configured to position the plurality of separate power feeding members, and wherein the plurality of separate power feeding members each includes: a connecting portion to be connected to a corresponding one of the voltage output portions; a positioning portion to be fitted into a corresponding one of the positioning holes; and a latching portion configured to latch the circuit board.

8 Claims, 5 Drawing Sheets

IMAGE FORMING APPARATUS INCLUDING POWER FEEDING MEMBERS CONFIGURED TO HOLD A CIRCUIT BOARD

BACKGROUND OF THE INVENTION

1. Field of the Invention

The present invention relates to an image forming apparatus configured to form an image on a recording medium.

2. Description of the Related Art

An electrophotographic image forming apparatus is configured to form an image on a recording medium using an electrophotographic image forming process. As the electrophotographic image forming apparatus, for example, there are known an electrophotographic copying machine (such as digital copying machine), an electrophotographic printer (such as color laser beam printer and color LED printer), a multifunction peripheral (MFP), a facsimile apparatus, and a word processor. The electrophotographic image forming apparatus (hereinafter referred to as "image forming apparatus") not only encompasses an image forming apparatus configured to form a monochrome image but also encompasses a color image forming apparatus configured to form a color image.

The image forming apparatus includes a plurality of process units such as a photosensitive member, a charging device, a light scanning device (exposure device), a developing device, a transferring device, and a fixing device. The charging device uniformly charges a surface of the photosensitive member (image bearing member). The light scanning device emits a laser beam (hereinafter referred to as "light beam") modulated in accordance with image information onto the uniformly charged surface of the photosensitive member so as to form an electrostatic latent image on the surface of the photosensitive member. The developing device develops the electrostatic latent image into a developer image (toner image) using a developer (toner). The transferring device transfers the toner image, which is formed on the surface of the photosensitive member, onto the recording medium. The fixing device fixes the toner image onto the recording medium by heating and pressurizing the recording medium having the toner image transferred thereon. In this manner, the image forming apparatus forms an image on the recording medium.

The image forming apparatus includes a high-voltage circuit board configured to apply a high voltage to each of the photosensitive member, the charging device, the developing device, the transferring device, and the fixing device.

The photosensitive member, the charging device, the developing device, the transferring device, and the fixing device are electrically connected to the high-voltage circuit board through respective power feeding members.

U.S. Pat. No. 8,750,745 discloses an image forming apparatus including power feeding members which are electrically connected to respective high-voltage contact portions of a high-voltage circuit board through springs and hold the high-voltage circuit board.

However, in the related art, the plurality of power feeding members configured to feed high voltages to a plurality of process units, respectively, are connected to a single integrated holding member. Therefore, when the high-voltage circuit board is deformed due to heat or force, the position of the high-voltage contact portion of the high-voltage circuit board may be displaced from the position of the spring of the power feeding member. When the high-voltage contact portion and the spring of the power feeding member are displaced from each other, there is a problem in that reliability of electrical connection is degraded.

SUMMARY OF THE INVENTION

To address the above-mentioned problem, according to one embodiment of the present invention, there is provided an image forming apparatus configured to form an image on a recording medium, the image forming apparatus comprising:

a plurality of process units to which voltages are applied to perform image forming processes;

a circuit board configured to generate the voltages to be applied to the plurality of process units, respectively; and a plurality of separate power feeding members configured to supply the voltages generated by the circuit board to the plurality of process units, respectively, wherein the plurality of separate power feeding members are configured to hold the circuit board, wherein the circuit board comprises:

a plurality of voltage output portions configured to output the voltages to be applied to the plurality of process units, respectively, the plurality of voltage output portions being arranged at different positions in a direction along an outer edge of the circuit board; and a plurality of positioning holes configured to position the plurality of separate power feeding members, respectively, and wherein the plurality of separate power feeding members each comprises:

a connecting portion to be connected to a corresponding one of the plurality of voltage output portions of the circuit board;

a positioning portion to be fitted into a corresponding one of the plurality of positioning holes of the circuit board, the positioning portion being arranged at a position closer to the outer edge of the circuit board than a position of the connecting portion; and a latching portion configured to latch the circuit board, the latching portion being arranged at a different position from the position of the positioning portion in the direction along the outer edge.

Further features of the present invention will become apparent from the following description of exemplary embodiments with reference to the attached drawings.

DESCRIPTION OF THE EMBODIMENTS

Now, an embodiment of the present invention will be described.

(Image Forming Apparatus)

Figure 1:
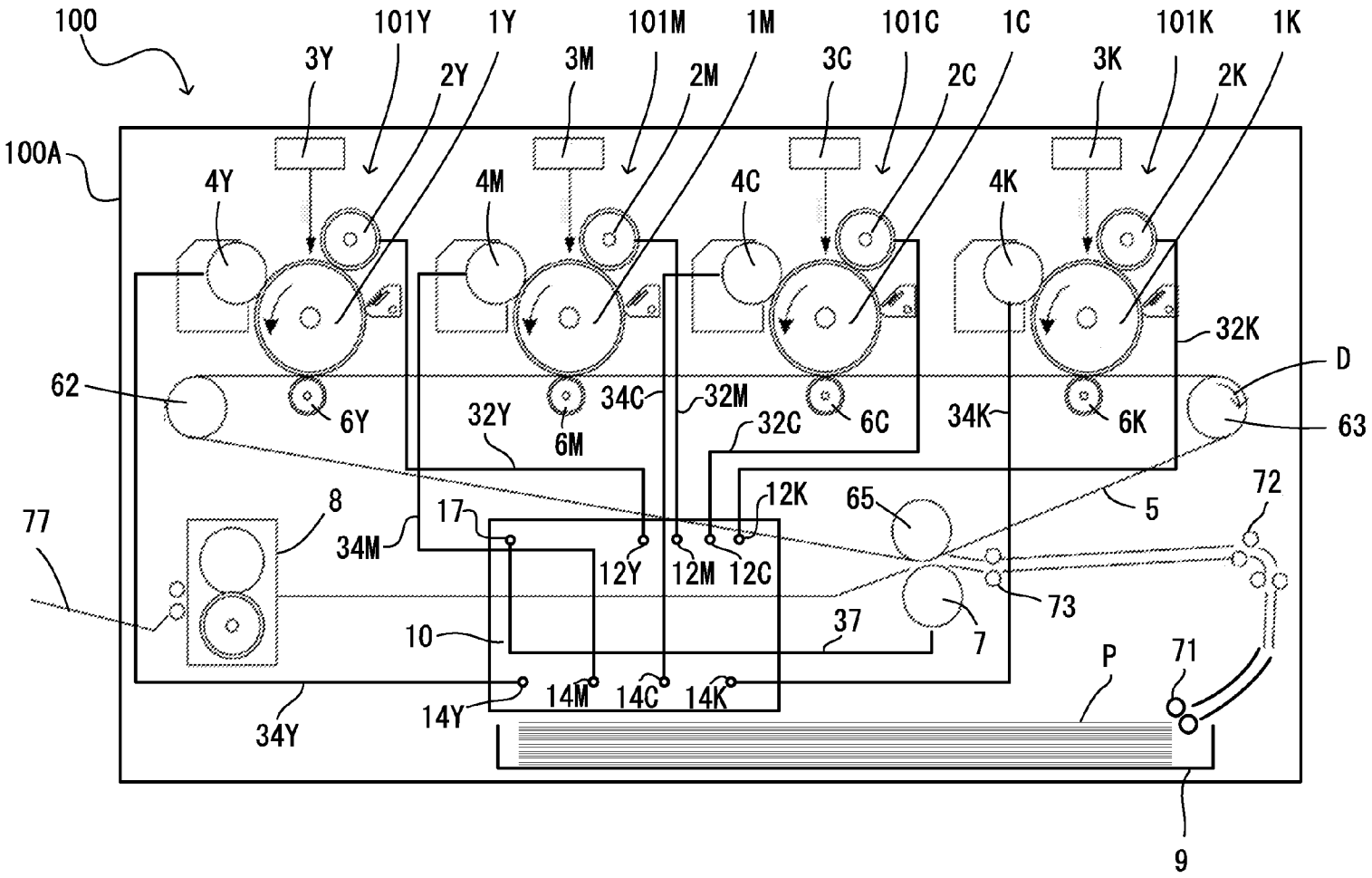
FIG. 1 is an explanatory view of an image forming apparatus.

FIG. 1 is an explanatory view of an image forming apparatus 100. The image forming apparatus 100 is configured to form an image on a recording medium P using an electrophotographic image forming process.

A main body 100A of the image forming apparatus 100 includes four image forming portions 101 (101Y, 101M, 101C, and 101K). The image forming portion 101Y is configured to form a yellow image using yellow toner. The image forming portion 101M is configured to form a magenta image using magenta toner. The image forming portion 101C is configured to form a cyan image using cyan toner. The image forming portion 101K is configured to form a black image using black toner. The four image forming portions 101 have the same structure except for the colors of the developer (toner), and hence, in the following description, the suffixes Y, M, C, and K are omitted from reference symbols unless otherwise deemed necessary.

The image forming portions 101 include photosensitive drums (image bearing members) 1 (1Y, 1M, 1C, and 1K) serving as photosensitive members, respectively. Around the photosensitive drums 1, there are arranged charging rollers (charging devices) 2 (2Y, 2M, 2C, and 2K), light scanning devices 3 (3Y, 3M, 3C, and 3K), developing devices 4 (4Y, 4M, 4C, and 4K), and primary transfer rollers (primary transfer devices) 6 (6Y, 6M, 6C, and 6K), respectively. An endless intermediate transfer belt (intermediate transfer member) 5 is arranged below the photosensitive drums 1.

The intermediate transfer belt 5 is stretched around a drive roller 62 and two driven rollers 63 and 65. The intermediate transfer belt 5 rotates in a direction indicated by the arrow D of FIG. 1 at the time of image formation. The primary transfer rollers 6 are arranged across the intermediate transfer belt 5 so as to be opposite to the photosensitive drums 1, respectively. The primary transfer roller 6 transfers a toner image, which is formed on the photosensitive drum 1, onto the intermediate transfer belt 5.

A secondary transfer roller (secondary transfer device) 7 is arranged across the intermediate transfer belt 5 so as to be opposite to the driven roller 65.

A sheet feeding cassette 9 configured to receive the recording medium P is arranged in a lower part of the image forming apparatus 100. The recording medium P is fed from the sheet feeding cassette 9 by pick-up rollers 71. The recording medium P is conveyed to the secondary transfer roller 7 by a conveyance rollers 72 and registration rollers 73.

A fixing device 8 is arranged on a downstream side of the secondary transfer roller 7 in a conveyance direction of the recording medium P. A delivery tray 77 on which the recording medium P on which an image has been formed is stacked is provided on a downstream side of the fixing device 8 in the conveyance direction of the recording medium P.

(Image Forming Process)

Next, an image forming process of the image forming apparatus 100 will be described. The image forming processes in the four image forming portions 101 are the same, and hence the image forming process in the yellow image forming portion 101Y will be described. The description of the image forming processes of the magenta image forming portion 101M, the cyan image forming portion 101C, and the black image forming portion 101K is omitted.

The charging roller 2Y uniformly charges a surface of the photosensitive drum 1Y. The light scanning device 3Y emits a light beam modulated in accordance with image information of a yellow component onto the uniformly charged surface of the photosensitive drum 1Y to form an electrostatic latent image on the photosensitive drum 1Y. The developing device 4Y develops the electrostatic latent image using the yellow toner (developer) into a yellow toner image. The primary transfer roller 6Y primarily transfers the yellow toner image, which is formed on the photosensitive drum 1Y, onto the intermediate transfer belt 5.

In the same way, a magenta toner image formed by the magenta image forming portion 101M is accurately transferred onto the yellow toner image on the intermediate transfer belt 5 in a superimposed manner. Then, a cyan toner image and a black toner image are sequentially transferred onto the magenta toner image on the intermediate transfer belt 5 in a superimposed manner. As a result, the four-color toner images are superimposed on the intermediate transfer belt 5.

The recording medium P conveyed from the sheet feeding cassette 9 is conveyed to the secondary transfer roller 7 by the registration rollers 73 in synchronization with the toner images on the intermediate transfer belt 5. The four-color toner images superimposed on the intermediate transfer belt 5 are secondarily transferred onto the recording medium P by the secondary transfer roller 7 in a collective manner.

The recording medium P having the toner images transferred thereon is conveyed to the fixing device 8. The fixing device 8 fixes the toner images onto the recording medium P by heating and pressurizing the recording medium P. The recording medium P having the image formed thereon is delivered onto the delivery tray 77.

(High-Voltage Circuit Board)

The image forming apparatus 100 includes a high-voltage circuit board (hereinafter referred to as "circuit board") 10. The circuit board 10 is configured to generate a high voltage (voltage) to be applied to each of process units such as the photosensitive drum 1, the charging roller 2, the developing device 4, the primary transfer roller 6, the secondary transfer roller 7, and the fixing device 8.

The circuit board 10 includes a plurality of high-voltage contact portions (voltage output portions) 12 (12Y, 12M, 12C, and 12K) configured to output high voltages to be applied to the charging rollers (process units) 2 (2Y, 2M, 2C, and 2K), respectively. The circuit board 10 is configured to supply the high voltages from the plurality of high-voltage contact portions 12 to the plurality of charging rollers 2 via a plurality of separate power feeding members 32 (32Y, 32M, 32C, and 32K), respectively.

The circuit board 10 includes a plurality of high-voltage contact portions (voltage output portions) 14 (14Y, 14M, 14C, and 14K) configured to output high voltages to be applied to the developing devices (process units) 4 (4Y, 4M, 4C, and 4K), respectively. The circuit board 10 is configured to supply the high voltages from the plurality of high-voltage contact portions 14 to the plurality of developing devices 4 via a plurality of separate power feeding members 34 (34Y, 34M, 34C, and 34K), respectively.

The circuit board 10 is configured to supply a high voltage from a high-voltage contact portion (voltage output portion) 17 to the secondary transfer roller 7 via a power feeding member 37.

Figure 2A:
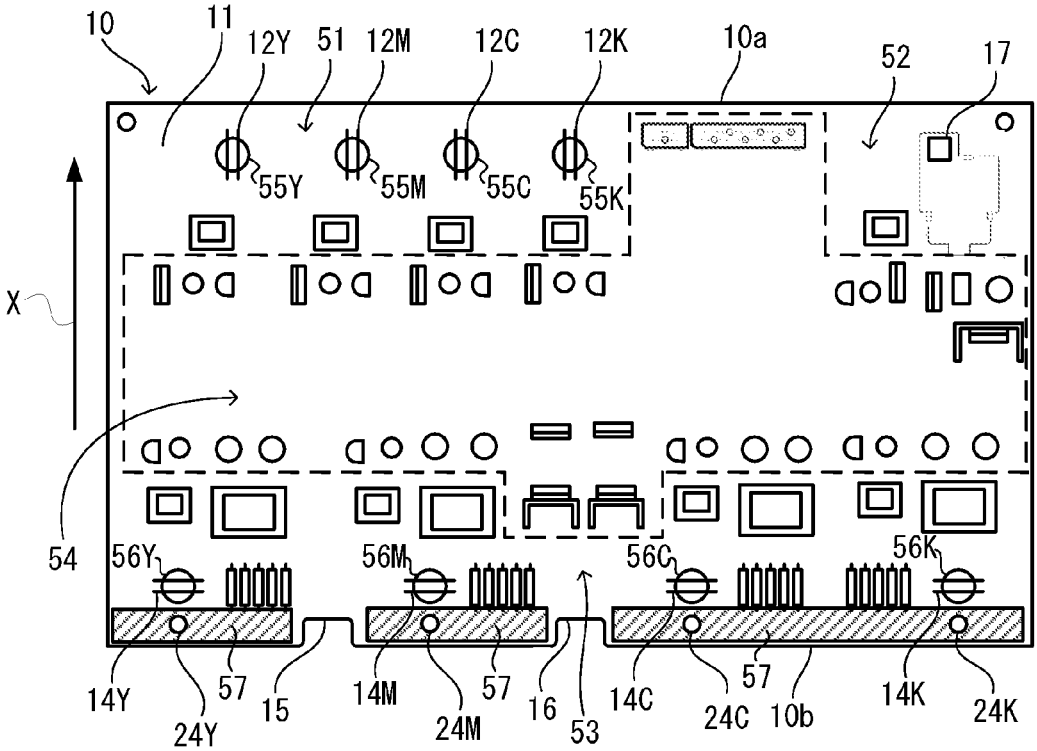
FIGS. 2A and 2B are explanatory views of a high-voltage circuit board.
Figure 2B:
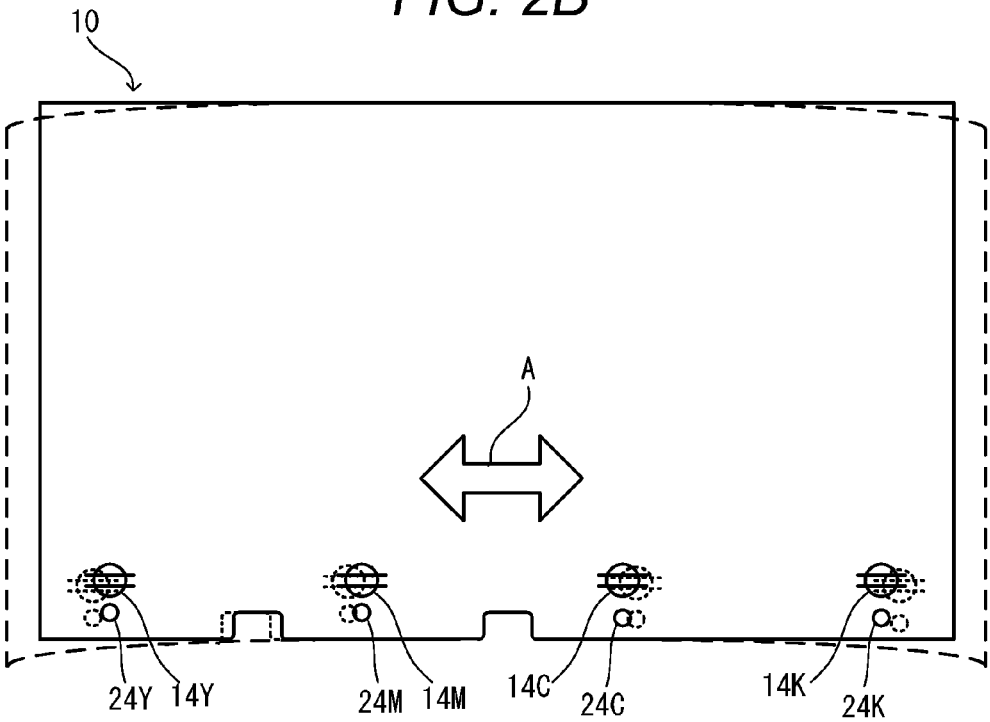

FIGS. 2A and 2B are explanatory views of the high-voltage circuit board 10. FIG. 2A is a plan view of the circuit board 10. FIG. 2B is an explanatory view of thermal deformation of the circuit board 10.

In FIG. 2A, a vertical direction is indicated by the arrow X. Various electrical components and electronic components are mounted on a mounting surface 11 of the circuit board 10. The circuit board 10 includes the high-voltage contact portions 12Y, 12M, 12C, and 12K in a high-voltage portion 51 on a side of an upper edge (outer edge) 10*a*. The high-voltage contact portions 12Y, 12M, 12C, and 12K are arranged in the vicinity of the upper edge 10*a* at different positions in a direction along the upper edge 10*a*. The circuit board 10 includes the high-voltage contact portion 17 in a high-voltage portion 52 in the vicinity of the upper edge 10*a*.

The circuit board 10 includes the high-voltage contact portions 14Y, 14M, 14C, and 14K in a high-voltage portion 53 on a side of a lower edge (outer edge) 10*b*. The high-voltage contact portions 14Y, 14M, 14C, and 14K are arranged in the vicinity of the lower edge 10*b* at different positions in a direction along the lower edge 10*b*. Further, low-voltage components for generating and controlling a high voltage are arranged in a center portion 54 of the circuit board 10.

The high-voltage contact portions 12Y, 12M, 12C, and 12K are each formed of two jumper wires. The high-voltage contact portions 12Y, 12M, 12C, and 12K are configured to feed the high voltages to the charging rollers 2Y, 2M, 2C, and 2K via the power feeding members 32Y, 32M, 32C, and 32K, respectively. Holes 55 (55Y, 55M, 55C, and 55K) are formed in the circuit board 10. Each of the holes 55 is arranged under the two jumper wires of each of the high-voltage contact portions 12Y, 12M, 12C, and 12K.

The contact between the high-voltage contact portion 12 and the power feeding member 32 can be visually confirmed through the hole 55.

The high-voltage contact portion 17 is an output portion of a fly back transformer. The high-voltage contact portion 17 is configured to feed the high voltage to the secondary transfer roller 7 via the power feeding member 37.

The high-voltage contact portions 14Y, 14M, 14C, and 14K are each formed of two jumper wires. The high-voltage contact portions 14Y, 14M, 14C, and 14K are configured to feed the high voltages to the developing devices 4Y, 4M, 4C, and 4K via the power feeding members 34Y, 34M, 34C, and 34K, respectively. Holes 56 (56Y, 56M, 56C, and 56K) are formed in the circuit board 10. Each of the holes 56 is arranged under the two jumper wires of each of the high-voltage contact portions 14Y, 14M, 14C, and 14K. The contact between the high-voltage contact portion 14 and the power feeding member 34 can be visually confirmed through the hole 56.

Boss holes (positioning holes) 24 (24Y, 24M, 24C, and 24K) are formed in the circuit board 10. Each of the boss holes 24 are arranged below the respective high-voltage contact portions 14Y, 14M, 14C, and 14K in the vertical direction X. It is appropriate that the boss hole 24 be formed right below the high-voltage contact portion 14. A boss (positioning portion) 38 (38Y, 38M, 38C, and 38K) (described later in FIG. 3) of the power feeding member 34 is inserted into the boss hole 24 so as to position the power feeding member 34 and the high-voltage contact portion 14. The boss hole 24 may be formed as a recessed portion serving as a positioning portion configured to position the power feeding member 34 and the high-voltage contact portion 14.

A creepage distance from the high-voltage portion 53 needs to be secured in regions (regions hatched in FIG. 2A) 57 between the high-voltage contact portions 14 configured to output the high voltage and the lower edge 10*b* of the circuit board 10, and hence electrical (electronic) components cannot be arranged in the regions 57. The boss hole 24 is formed in the region 57 in which the electrical (electronic) components cannot be arranged.

Furthermore, in order to enhance the workability at the time of removing the circuit board 10, cutouts (recessed portions) 15 and 16 having a sufficient size to insert a finger are formed in the lower edge 10*b* of the circuit board 10.

The circuit board 10 is liable to be deflected or thermally deformed due to its large dimensions. As illustrated in FIG. 2B, when thermally deformed, the circuit board 10 expands in both directions as indicated by the arrow A. When the circuit board 10 is deformed as described above, the high-voltage contact portion 14 may be displaced from a position in a normal state.

(Power Feeding Member)

Next, the power feeding members 34 will be described. The power feeding members 34 have a function of feeding the high voltages from the high-voltage contact portions 14 of the circuit board 10 to the respective developing devices 4. Furthermore, the power feeding members 34 have a function of holding the circuit board 10.

Figure 3:
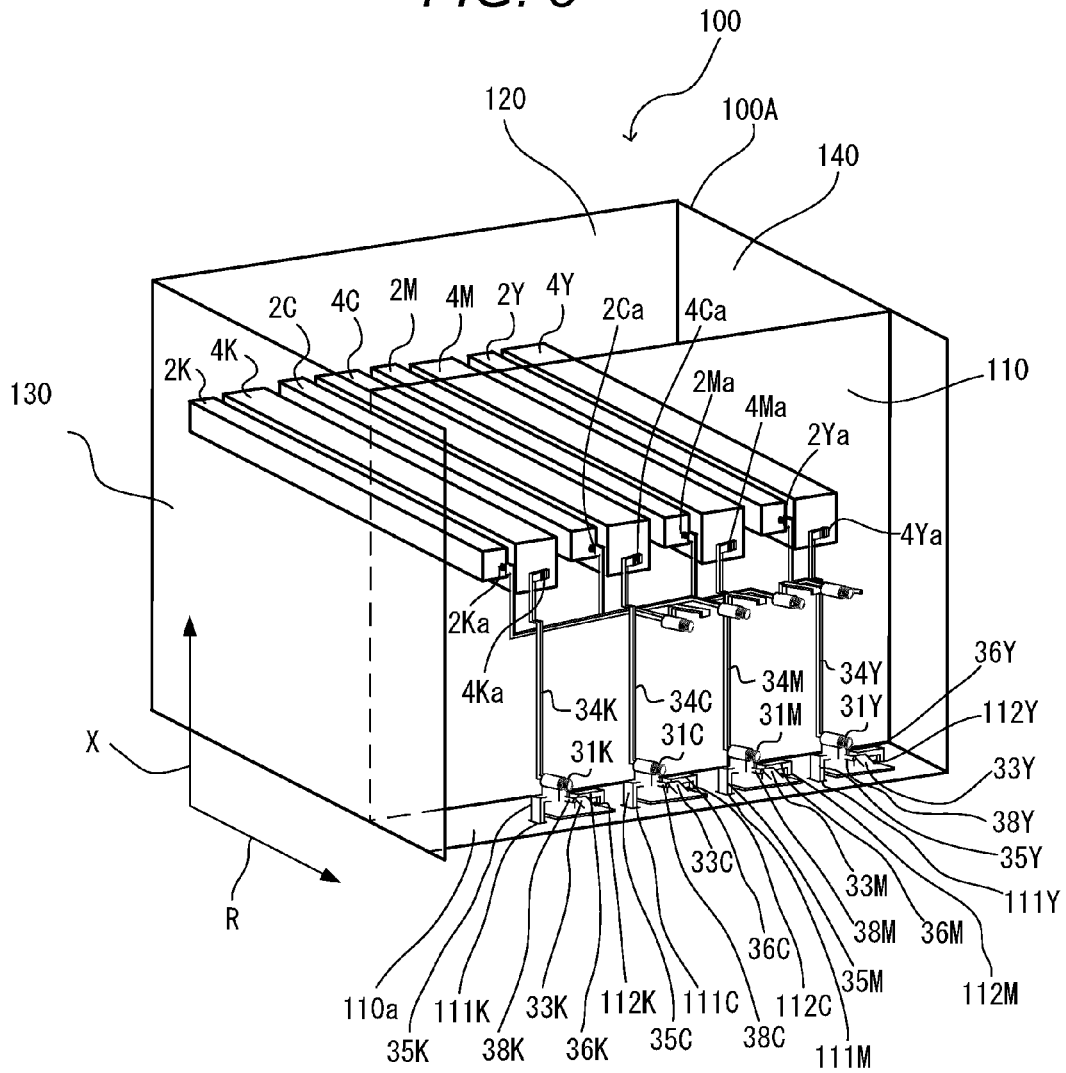
FIG. 3 is an explanatory view of power feeding members mounted on a main body of the image forming apparatus.

FIG. 3 is an explanatory view of the power feeding members 34Y, 34M, 34C, and 34K mounted on the main body 100A of the image forming apparatus 100. FIG. 3 is a rear view of the main body 100A of the image forming apparatus 100. A frame of the main body 100A is formed of a front plate 120 arranged on a front side of the main body 100A, a right plate 130 arranged on a right side of the main body 100A in front view, a left plate 140 arranged on a left side of the main body 100A in front view, and a rear plate 110 arranged on a rear side of the main body 100A.

The power feeding members 34Y, 34M, 34C, and 34K are mounted on the rear plate 110 so as to be separate from one another.

The charging rollers 2Y, 2M, 2C, and 2K and the developing devices 4Y, 4M, 4C, and 4K are supported by supporting members (not shown) mounted on the front plate 120 and the rear plate 110, respectively. The charging rollers 2Y, 2M, 2C, and 2K and the developing devices 4Y, 4M, 4C, and 4K have, on the side of the rear plate 110, electrical contacts 2Ya, 2Ma, 2Ca, and 2Ka and electrical contacts 4Ya, 4Ma, 4Ca, and 4Ka, respectively.

Circuit boards or the like (not shown) and driving components (not shown) are mounted on the rear plate 110. The circuit board 10 is mounted on the rear plate 110 so as to be held by the power feeding members 34Y, 34M, 34C, and 34K mounted on the rear plate 110.

The power feeding members 34Y, 34M, 34C, and 34K have the same shape. The power feeding members 34Y, 34M, 34C, and 34K are mounted on the rear plate 110 at the same intervals as those of the developing devices 4Y, 4M, 4C, and 4K. The power feeding members 34Y, 34M, 34C, and 34K are mounted on the rear plate 110 by each fitting a mold member 39 (ex. a mold member 39Y (FIG. 4A)) into mounting holes 111 (111Y, 111M, 111C, and 111K) and 112 (112Y, 112M, 112C, and 112K) opened in the rear plate 110.

Figure 5A:
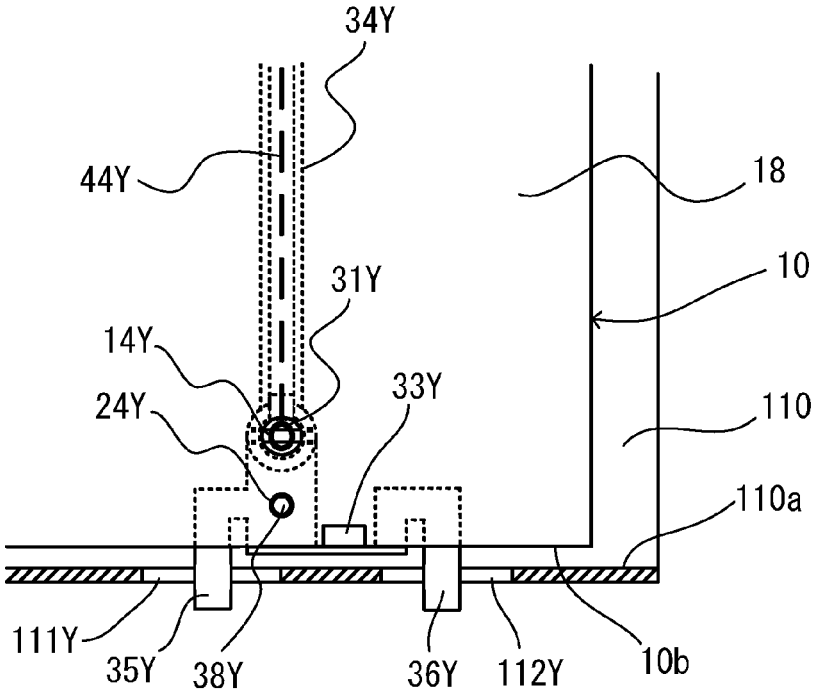
FIGS. 5A and 5B are explanatory views of the power feeding member holding the high-voltage circuit board.
Figure 5B:
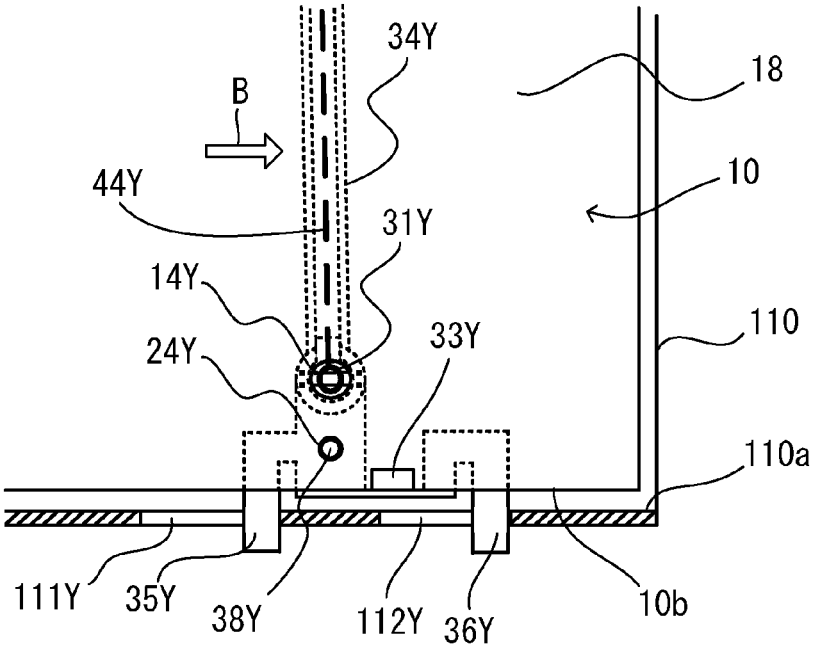

As illustrated in FIG. 5B described later, the power feeding members 34Y, 34M, 34C, and 34K are movable in a horizontal direction by approximately several millimeters even after being mounted on the rear plate 110. After the power feeding members 34Y, 34M, 34C, and 34K are mounted on the rear plate 110, the circuit board 10 is mounted on the rear plate 110 so that, while causing the mounting surface to face the rear plate 110, the high-voltage contact portions 12 and 14 are held in contact with the respective power feeding members 32 and 34. The contact between the high-voltage contact portion 14 and the power feeding member 34 can be visually confirmed through the hole 56 formed in the high-voltage contact portion 14 of the circuit board 10.

The power feeding members 34Y, 34M, 34C, and 34K are separate from one another. The power feeding members 34M, 34C, and 34K are the same as the power feeding member 34Y. Therefore, the power feeding member 34Y will be described below, and description of the power feeding members 34M, 34C, and 34K is omitted.

Figure 4A:
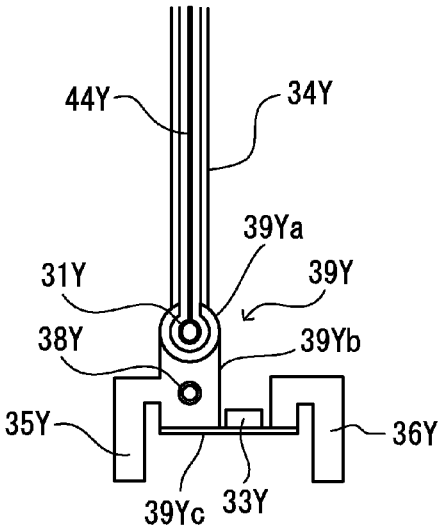
FIGS. 4A, 4B, 4C, and 4D are explanatory views of the power feeding member.
Figure 4B:
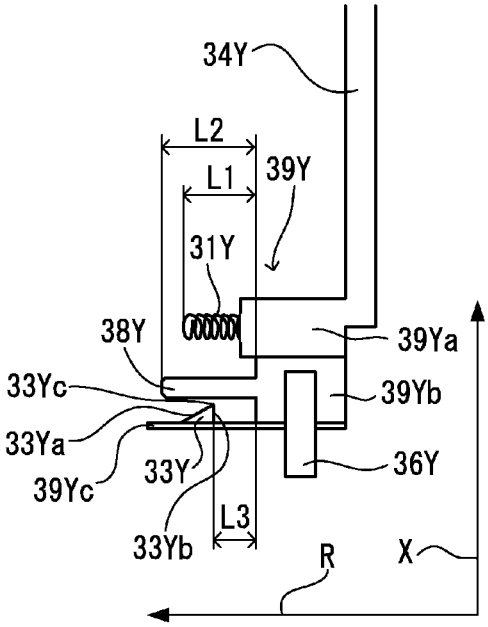
Figure 4C:
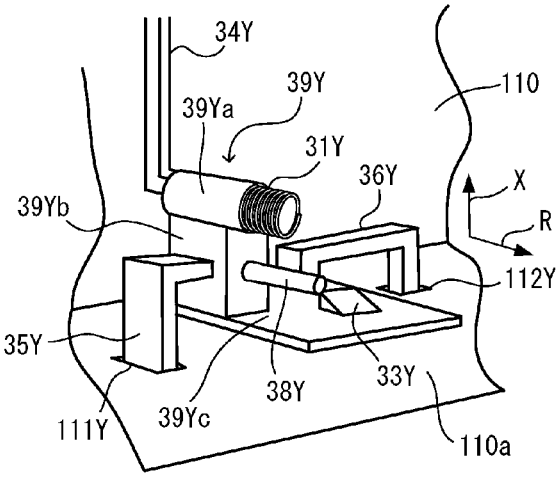
Figure 4D:
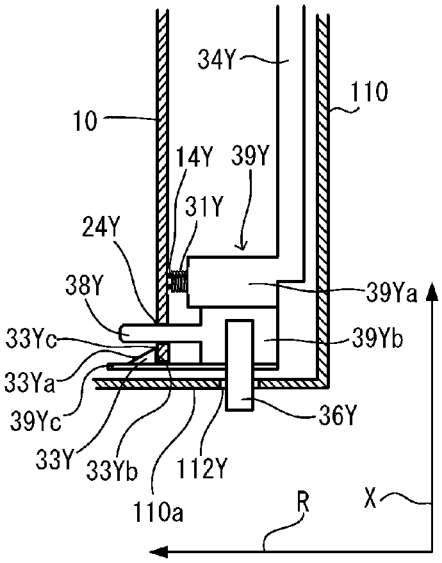

FIGS. 4A, 4B, 4C, and 4D are explanatory views of the power feeding member 34Y. FIG. 4A is a front view of the power feeding member 34Y. FIG. 4B is a side view of the power feeding member 34Y. FIG. 4C is a perspective view of the power feeding member 34Y mounted on the rear plate 110. FIG. 4D is a side view of the power feeding member 34Y holding the circuit board 10.

The power feeding member 34Y includes a wire (conductor) 44Y, a spring (conducting elastic member) 31Y, and a mold member (holding member) 39Y configured to hold the spring 31Y. The power feeding member 34Y is configured to hold the circuit board 10 by the mold member 39Y.

The wire 44Y extends inside the power feeding member 34Y, and is electrically connected to the electrical contact 4Ya of the developing device 4Y. The mold member 39Y includes a holding portion 39Ya configured to hold the spring 31Y, a base portion 39Yb which extends downward from the holding portion 39Ya, and a supporting plate 39Yc fixed to a lower portion of the base portion 39Yb. A boss (protruding portion) 38Y is formed on the base portion 39Yb of the mold member 39Y.

A latching portion (hereinafter referred to as "holding claw") 33Y configured to latch the circuit board is formed on the supporting plate 39Yc of the mold member 39Y. As illustrated in FIG. 5A described later, when the circuit board 10 is held by the power feeding member 34Y, the holding claw 33Y is arranged at a different position from that of the boss 38Y in the direction along the lower edge (outer edge) 10*b* of the circuit board 10.

The spring 31Y is a connecting portion configured to electrically connect the wire 44Y connected to the developing device 4Y and the high-voltage contact portion 14Y on the circuit board 10 to each other. The spring 31Y is a conducting elastic member having a coil shape. The spring 31Y is pressed toward the high-voltage contact portion 14Y while being held in contact with the high-voltage contact portion 14Y so that the spring 31Y is contracted while expressing a repulsive force. The spring 31Y is provided as a separate member from the wire 44Y, but may be integrally formed with the wire 44Y on one end portion of the wire 44Y.

The boss 38Y is a positioning portion configured to position the high-voltage contact portion 14Y of the circuit board 10 and the spring 31Y of the power feeding member 34Y. The boss 38Y protrudes from the base portion 39Yb of the mold member 39Y in a direction (hereinafter referred to as "protruding direction") R toward the circuit board 10.

When the circuit board 10 is to be mounted on the power feeding member 34Y (34M, 34C, 34K), the boss 38Y (38M, 38C, 38K) of the power feeding member 34Y (34M, 34C, 34K) is fitted into the boss hole 24Y (24M, 24C, 24K) of the circuit board 10. When the plurality of bosses 38 are fitted into the plurality of boss holes 24, respectively, the springs 31 of the plurality of power feeding members 34 can be positioned with respect to the plurality of high-voltage contact portions 14 of the circuit board 10, respectively, so as to be separate from one another.

When the circuit board 10 is mounted on the power feeding member 34, the boss 38 is arranged between the spring 31 and a portion, which is closest to the spring 31, of the lower edge 10*b* of the circuit board 10.

The holding claw 33Y is formed on the supporting plate 39Yc so as to hold the circuit board 10. As illustrated in FIG. 4B, the holding claw 33Y has a triangular shape in cross section.

The holding claw 33Y has an inclined portion 33Ya inclined downward toward the protruding direction R. The protruding direction R is a direction from a front of the main body 100A of the image forming apparatus 100 to a rear of the main body 100A. The holding claw 33Y has a latching surface (circuit board contact surface) 33Yb on the side of the base portion 39Yb. The holding claw 33Y has a portion 33Yc which has the maximum height in the vertical direction X between the inclined portion 33Ya and the latching surface 33Yb.

When the circuit board 10 is to be mounted on the power feeding member 34Y, the circuit board 10 is pushed toward the side of the power feeding member 34Y with respect to the portion 33Yc of the holding claw 33Y which has the maximum height in the vertical direction X. The supporting plate 39Yc is elastically deformable. The circuit board 10 presses the holding claw 33Y downward so that the supporting plate 39Yc is deflected downward. With the downward deflection of the supporting plate 39Yc, the circuit board 10 climbs over the portion 33Yc of the holding claw 33Y. The circuit board 10 is pressed toward the latching surface 33Yb of the holding claw 33Y due to the repulsive force of the spring 31Y. The circuit board 10 is fixed by the spring 31Y and the latching surface 33Yb.

As illustrated in FIG. 4B, when the circuit board is not held by the power feeding member 34Y, in the protruding direction R in which the boss 38Y protrudes, the boss 38Y extends more than the spring 31Y, and the spring 31Y extends more than the latching surface 33Yb of the holding claw 33Y. In other words, in the protruding direction R, a protruding amount of the boss 38Y is larger than a protruding amount of the spring 31Y. Further, a distal end portion of the spring 31Y protrudes in the protruding direction R more than the latching surface 33Yb of the holding claw 33Y.

That is, a length L1 in the protruding direction R from the base portion 39Yb of the mold member 39Y to the distal end portion of the spring 31Y when the spring 31Y is in a natural state is smaller than a length L2 in the protruding direction R from the base portion 39Yb to a distal end portion of the boss 38Y. Further, the length L1 is larger than a length L3 in the protruding direction R from the base portion 39Yb of the mold member 39Y to the latching surface 33Yb of the holding claw 33Y.

With this configuration, before the spring 31Y is held in contact with the high-voltage contact portion 14Y, the circuit board 10 and the power feeding member 34Y are positioned by the boss 38Y, that is, the spring 31Y and the high-voltage contact portion 14Y are positioned. Therefore, the spring 31Y is held in contact with the high-voltage contact portion 14Y without buckling. Further, after being held in contact with the spring 31Y, the circuit board 10 is further pushed so that the circuit board 10 is latched by the latching surface 33Yb. As illustrated in FIG. 4D, the circuit board 10 is fixed by the holding claw 33Y with a predetermined spring force of the spring 31Y without using a screw.

In the same way, the respective positioning between springs 31M, 31C, and 31K and the high-voltage contact portions 14M, 14C, and 14K are independently performed by the bosses 38M, 38C, and 38K of the power feeding members 34M, 34C, and 34K. The positioning of the springs 31M, 31C, and 31K and the high-voltage contact portions 14M, 14C, and 14K is the same as the positioning of the spring 31Y and the high-voltage contact portion 14Y, and description thereof is omitted.

(Fixing portion)

As illustrated in FIGS. 4A and 4C, the mold member 39Y includes fixing portions 35Y and 36Y configured to fix the power feeding member 34Y. The fixing portion 35Y has an inverted L-shape, and is integrally formed with the base portion 39Yb of the mold member 39Y. The fixing portion 36Y has an inverted J-shape, and is integrally formed with the supporting plate 39Yc of the mold member 39Y.

As illustrated in FIGS. 3 and 4C, a shelf portion 110*a* which extends toward the protruding direction R is formed on the rear plate 110. Mounting holes 111Y and 112Y, into which the fixing portions 35Y and 36Y are inserted, respectively, are formed in the shelf portion 110*a*.

The power feeding member 34Y is mounted on the rear plate 110 by inserting the fixing portions 35Y and 36Y into the mounting holes 111Y and 112Y formed in the shelf portion 110*a* of the rear plate 110, respectively. The mounting holes 111Y and 112Y have a sufficient size to receive the fixing portions 35Y and 36Y. The mounting holes 111Y and 112Y are larger than the fixing portions 35Y and 36Y, and a gap between an inner periphery of each of the mounting holes 111Y and 112Y and an outer periphery of each of the fixing portions 35Y and 36Y is several millimeters. Therefore, even after the power feeding member 34Y is mounted on the rear plate 110, the power feeding member 34Y is movable by approximately several millimeters.

The fixing portions 35M, 36M, 35C, 36C, 35K, and 36K of the power feeding members 34M, 34C, and 34K are the same as the fixing portions 35Y and 36Y of the power feeding member 34Y, and description thereof is omitted. Furthermore, the mounting holes 111M, 112M, 111C, 112C, 111K, and 112K formed in the shelf portion 110*a*, into which the fixing portions 35M, 36M, 35C, 36C, 35K, and 36K are inserted, respectively, are the same as the mounting holes 111Y and 112Y, and description thereof is omitted.

FIGS. 5A and 5B are explanatory views of the power feeding member 34Y holding the high-voltage circuit board 10. FIGS. 5A and 5B are views as seen from a side of a solder surface 18 opposite to the mounting surface 11 of the circuit board 10. FIG. 5A is an explanatory view of the circuit board 10 in a state in which the circuit board 10 is not deformed. FIG. 5B is an explanatory view of the circuit board 10 in a state in which the circuit board 10 is deformed in a direction indicated by the arrow B and the position of the boss hole 24Y is therefore displaced so that the position of the power feeding member 34Y is displaced.

As is understood from FIG. 5B, when the circuit board 10 is deformed, the power feeding member 34Y is movable in the horizontal direction by approximately several millimeters as described above. The boss hole 24Y and the high-voltage contact portion 14Y of the circuit board 10 are arranged close to each other. Furthermore, the boss 38Y and the spring 31Y of the power feeding member 34Y are arranged close to each other. Therefore, when the circuit board 10 is deformed, the positional relationship between the boss hole 24Y and the high-voltage contact portion 14Y of the circuit board 10 is not substantially changed. Accordingly, even when the circuit board 10 is deformed, the power feeding member 34Y moves in association with the deformation of the circuit board 10 by the insertion of the boss 38Y into the boss hole 24Y of the circuit board 10, with the result that the connection between the high-voltage contact portion 14Y and the spring 31Y can reliably be maintained.

As described above, the plurality of power feeding members 34, each including the spring 31, the boss configured to position the circuit board 10, and the fixing portions 35 and 36 configured to mount the power feeding member 34 so as to be movable with respect to the main body 100A, are provided separately from one another. Therefore, even when the circuit board 10 is deformed, the reliability of the connection between the spring 31 and the high-voltage contact portion 14 is improved. Furthermore, the circuit board 10 is easily fixed to the power feeding members 34.

Furthermore, the holding claw 33 is arranged in the vicinity of the spring 31, and hence the power feeding member 34 can hold the circuit board 10 while preventing the deflection of the circuit board 10.

As described above, the circuit board 10 has the boss holes 24 formed below the plurality of high-voltage contact portions 14 in the vertical direction X, respectively. The plurality of power feeding members 34 which are separate from one another are provided for the plurality of high-voltage contact portions 14, respectively. The plurality of power feeding members 34 each include the spring 31, the boss 38 formed below the spring 31 in the vertical direction X, and the holding claw 33 in the vicinity of the boss 38. The power feeding member 34 is movable even after being mounted on the rear plate 110. Therefore, even when the circuit board 10 is deformed, the connection between the spring 31 and the high-voltage contact portion 14 can reliably be maintained. Accordingly, only by the mounting of the circuit board 10 to the power feeding member 34 so that the boss 38 is fitted into the boss hole 24, the connection between the spring 31 and the high-voltage contact portion 14 can reliably be maintained, with the result that the mounting of the circuit board 10 is facilitated.

According to the embodiment, the plurality of separate power feeding members each includes the connecting portion, the positioning portion, and the latching portion. Therefore, even when the circuit board is deformed, the connection between the voltage output portion of the circuit board and the connecting portion can reliably be maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-006829, filed Jan. 17, 2014, which is hereby incorporated by reference herein in its entirety.

What is claimed is:

1. An image forming apparatus configured to form an image on a recording medium, the image forming apparatus comprising:

a plurality of process units to which voltages are applied to perform image forming processes;

a circuit board configured to generate the voltages to be applied to the plurality of process units, respectively; and a plurality of separate power feeding members configured to supply the voltages generated by the circuit board to the plurality of process units, respectively, wherein the plurality of separate power feeding members are configured to hold the circuit board, wherein the circuit board comprises:

a plurality of voltage output portions configured to output the voltages to be applied to the plurality of process units, respectively, the plurality of voltage output portions being arranged at different positions in a direction along an outer edge of the circuit board; and a plurality of positioning holes configured to position the plurality of separate power feeding members, respectively, and wherein the plurality of separate power feeding members each comprises:

a connecting portion to be connected to a corresponding one of the plurality of voltage output portions of the circuit board;

a positioning portion to be fitted into a corresponding one of the plurality of positioning holes of the circuit board, the positioning portion being arranged at a position closer to the outer edge of the circuit board than a position of the connecting portion; and a latching portion configured to latch the circuit board, the latching portion being arranged at a different position from the position of the positioning portion in the direction along the outer edge.

2. An image forming apparatus according to claim 1, wherein the plurality of separate power feeding members are mounted to a main body of the image forming apparatus so as to be movable with respect to the main body.

3. An image forming apparatus according to claim 1, wherein the positioning portion is arranged between the connecting portion and a portion, which is closest to the connecting portion, of the outer edge.

4. An image forming apparatus according to claim 1, wherein the connecting portion comprises a conducting elastic member, wherein the positioning portion comprises a protruding portion, and wherein, when the circuit board is not held by the plurality of separate power feeding members, in a protruding direction in which the protruding portion protrudes, the protruding portion extends more than the conducting elastic member, and the conducting elastic member extends more than a latching surface on which the latching portion latches the circuit board.

5. An image forming apparatus according to claim 1, wherein the outer edge comprises a lower edge of the circuit board, and wherein the lower edge of the circuit board is provided with a recessed portion.

6. An image forming apparatus according to claim 1, further comprising:

a plurality of photosensitive members; and a plurality of charging devices to which voltages are applied to charge the plurality of photosensitive members, respectively, wherein the plurality of process units comprise a plurality of developing devices configured to develop electrostatic latent images formed on the plurality of photosensitive members, respectively, wherein the circuit board further comprises a plurality of voltage output portions configured to output the voltages to be applied to the plurality of charging devices, respectively, wherein the outer edge comprises a lower edge of the circuit board, wherein the plurality of voltage output portions configured to output the voltages to be applied to the plurality of process units, respectively, are arranged in a vicinity of the lower edge, and wherein the plurality of voltage output portions configured to output the voltages to be applied to the plurality of charging devices, respectively, are arranged in a vicinity of an upper edge of the circuit board at different positions in a direction along the upper edge.

7. An image forming apparatus according to claim 1, wherein each of the plurality of separate power feeding members comprises a fixing portion to be inserted into a mounting hole formed in the image forming apparatus.

8. An image forming apparatus according to claim 7, wherein the each of the plurality of separate power feeding members comprises a holding member provided on one end portion thereof, the holding member integrally comprising the connecting portion, the positioning portion, the latching portion, and the fixing portion.

* * * * *